US009967669B2

(12) United States Patent
Zhang

(10) Patent No.: US 9,967,669 B2
(45) **Date of Patent: *May 8, 2018**

(54) RECORDING DEVICE AND FIXED APPARATUS

(71) Applicant: Scenes Sound Digital Technology (Shenzhen) Co., Ltd, Shenzhen (CN)

(72) Inventor: Ruibo Zhang, Shenzhen (CN)

(73) Assignee: Scenes Sound Digital Technology (Shenzhen) Co., Ltd., Shenzhen (CN)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/474,001

(22) Filed: Mar. 30, 2017

(65) Prior Publication Data

US 2017/0295430 A1 Oct. 12, 2017

(30) Foreign Application Priority Data

Apr. 11, 2016 (CN) ..... 2016 1 0221603

(51) Int. Cl.
*H04R 5/027* (2006.01)
*H04R 5/04* (2006.01)
*H04S 7/00* (2006.01)

(52) U.S. Cl.
CPC ..... *H04R 5/027* (2013.01); *H04R 5/04* (2013.01); *H04S 7/303* (2013.01); *H04S 2400/15* (2013.01); *H04S 2420/01* (2013.01)

(58) Field of Classification Search
CPC H04R 5/027; H04R 5/04; H04S 7/303; H04S 2400/15; H04S 2420/01
See application file for complete search history.

(56) References Cited

U.S. PATENT DOCUMENTS 4,119,798 A * 10/1978 Iwahara ..... H04S 3/002 381/19

* cited by examiner

*Primary Examiner* — Sonia Gay
(74) *Attorney, Agent, or Firm* — Ladas & Parry LLP

(57) ABSTRACT

The present invention is applicable to the field of audio recording and provides a recording device and a fixed apparatus. The recording device includes several fixed apparatuses that are stacked, and the fixed apparatus has a first fixed structure and a second fixed structure; the first fixed structure includes a first simulated face structure and first simulated ear structures, and the first simulated ear structures simulate a mutual position relationship between human ears and a human face and are disposed on two sides of the first simulated face structure; the second fixed structure includes a second simulated face structure and second simulated ear structures; the second simulated face structure and the first simulated face structure are inverted to each other, and the second simulated ear structures and the second simulated face structure are inverted to each other; and audio collectors are disposed at simulated ear canal openings of the first simulated ear structures and the second simulated ear structures.

12 Claims, 4 Drawing Sheets

RECORDING DEVICE AND FIXED APPARATUS

This application claims priority to Chinese Patent Application No. 201610221603.3, filed with the Chinese Patent Office on Apr. 11, 2016 and entitled "RECORDING DEVICE AND FIXED APPARATUS", which is incorporated herein by reference in its entity. This application is a continuation application of PCT Patent Application No. PCT/CN2016/089845.

TECHNICAL FIELD

The present invention belongs to the field of audio recording, and particularly, relates to a recording device and a fixed apparatus.

BACKGROUND

In a process of receiving sound waves by human ears, the auricle, the ear canal, the skull, the shoulder, and the like may reflect and diffract the sound waves, and then the sound waves are conducted to the ear drum and perceived by brain nerves. All these have certain impact on sounds heard by the human ears. In acoustics, such impact is described by using a head related transfer function (HRTF). Therefore, the human brain can determine a position and a distance of an emitted sound according to experience. Based on this, in recent years, a more advanced simulated human head recording technology has been increasingly more favored in the field of audio recording.

In short, the simulated human head recording technology means that two micro omni-directional microphones are placed in positions close to ear drums in ear canals of an artificial human head that is almost the same as a real human head, so as to simulate an entire process of hearing sounds by the human ears. The artificial human head has auricles, ear canals, a skull, hair, and shoulders, and even skin and bones are also made of materials most approximate to human body materials, so as to simulate as really as possible impact exerted by all HRTFs on the human ears when hearing sounds.

Signals recorded by such two microphones are equal to sounds heard by both ears of a real person at the position of the artificial human head, the impact of all the HRTFs in the recording process are recorded and can be restored and replayed. Sounds recorded in this manner can almost perfectly restore a sound field at 360 degrees of a recording site as if a hearer is on the recording site. Certainly, during playing, a good stereo effect can also be achieved by playing the sounds with a loudspeaker, but is incomparable to that of an earphone, because in the process of playing the sounds with the loudspeaker, a listener is subjected to impact of the HRTF once again, and original HRTF information in a disk is disturbed.

In addition, with the development and popularization of a virtual reality (VR) panoramic video technology, a visual angle of a picture is changed by means of head tracking, so that a visual system and a motion perception system of a user are connected, and the user can observe a presented scene through head motion. A VR panoramic video device enables the user to watch a video at any visual angle within 360 degrees. In order to bring stereo perception experience to users by using the VR panoramic video technology, an audio recording technology in a panoramic video also becomes a focus, and combining the simulated human head recording technology and the VR panoramic video technology becomes a new research direction.

An audio recording device used in an existing VR panoramic video technology has many limitations, not only a sound source is single, but also tone quality is flat and non-stereoscopic, a real sound field cannot be restored, and a requirement for high-quality panoramic audio in the VR panoramic video technology cannot be met.

SUMMARY

Embodiments of the present invention provide a recording device and aims to resolve problems that an audio recording device used in an existing VR panoramic video technology is single in sound source, has flat and non-stereoscopic tone quality, and cannot restore a real sound field or meet a requirement for high-quality panoramic audio in the VR panoramic video technology.

The embodiments of the present invention are implemented in the following manner: A recording device includes:

several fixed apparatuses that are stacked, where the fixed apparatus has a first fixed structure and a second fixed structure that are used for installing an audio collector; where the first fixed structure includes a first simulated face structure and first simulated ear strictures, and the first simulated ear structures simulate a mutual position relationship between human ears and a human face of a human head and are disposed on two sides of the first simulated face structure;

the second fixed structure includes a second simulated face structure and second simulated ear structures disposed on two sides of the second simulated face structure, the second simulated face structure and the first simulated face structure are inverted to each other, and the second simulated ear structures and the second simulated face structure are inverted to each other; and the first simulated ear structures and the second simulated ear structures include simulated ear canal openings for placing the audio collector.

The embodiments of the present invention further provide a fixed apparatus, and the fixed apparatus has a first fixed structure and a second fixed structure that are used for installing an audio collector;

the first fixed structure includes a first simulated face structure and first simulated ear structures, and the first simulated ear structures simulate a position relationship between human ears and a human face of a human head and are disposed on two sides of the first simulated face structure;

the second fixed structure includes a second simulated face structure and second simulated ear structures disposed on two sides of the second simulated face structure, the second simulated face structure and the first simulated face structure are inverted to each other, and the second simulated ear structures and the second simulated face structure are inverted to each other; and the first simulated ear structures and the second simulated ear structures include simulated ear canal openings for placing the audio collector.

The present invention provides a recording device. Several fixed apparatuses cooperate with audio collectors disposed on the fixed apparatuses. By using a first fixed structure that has a first simulated face structure and first simulated ear structures and a second fixed structure that has a second simulated face structure and second simulated ear structures, sounds collected by audio collectors disposed in ear canals of the first simulated ear structures and the second simulated ear structures have richer sources and better stereoscopic sensation, an optimal 720-degree panoramic sound field for simulating human head sounds is restored, and requirements of an experience for high-quality audio and experience of being personally on the scene in a VR panoramic video technology are met.

DESCRIPTION OF EMBODIMENTS

To make the objectives, technical solutions, and advantages of the present invention clearer and more comprehensible, the following further describes the present invention in detail with reference to the accompanying drawings and embodiments. It should be understood that the specific embodiments described herein are merely used to explain the present invention but are not intended to limit the present invention.

The present invention provides a recording device. Several fixed apparatuses cooperate with audio collectors disposed on the fixed apparatuses. By using a first fixed structure that has a first simulated face structure and first simulated ear structures and a second fixed structure that has a second simulated face structure and second simulated ear structures, sounds collected by audio collectors disposed in ear canals of the first simulated ear structures and the second simulated ear structures have richer sources and better stereoscopic sensation, an optimal 720-degree panoramic sound field for simulating human head sounds is restored, and requirements of an experience for high-quality audio and experience of being personally on the scene in a VR panoramic video technology are met.

Figure 1:
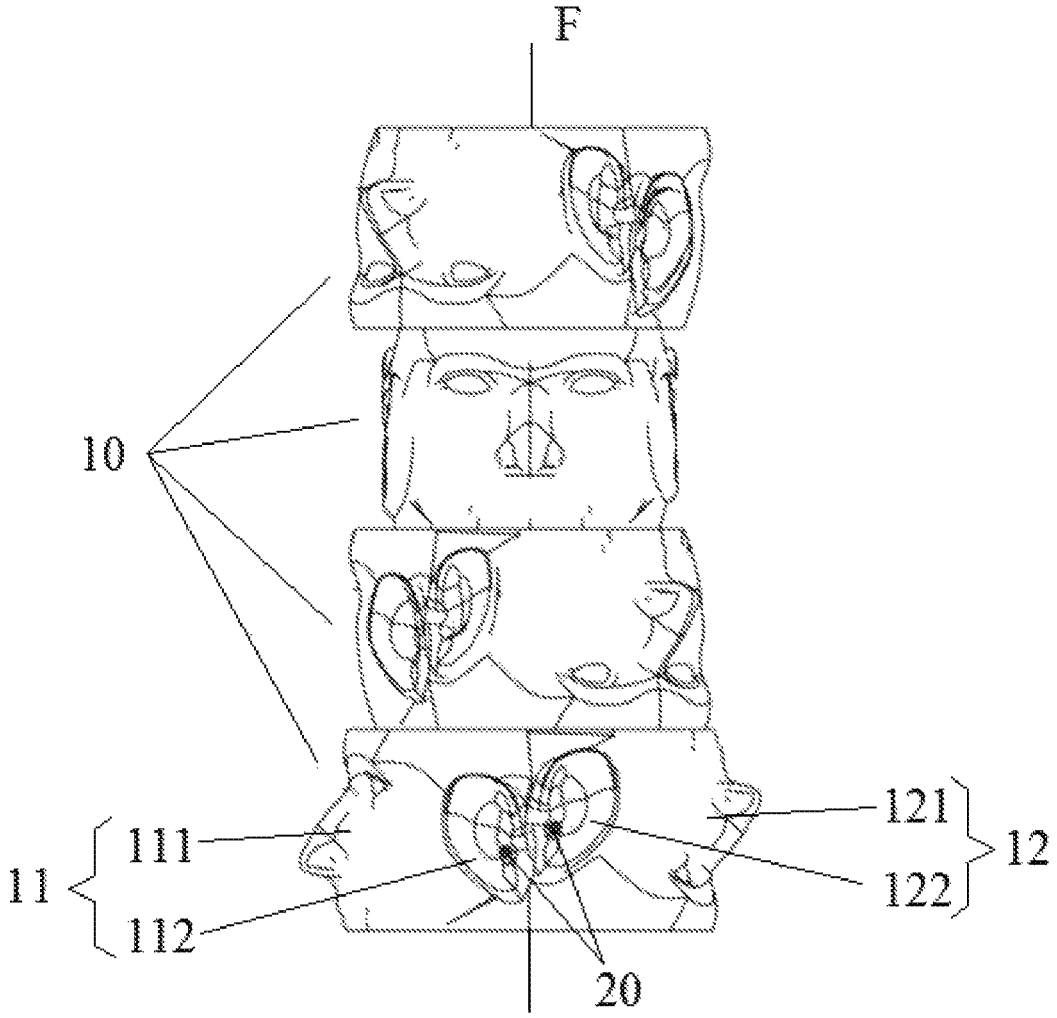
FIG. 1 is a structural diagram of a recording device according to an embodiment of the present invention.
Figure 2:
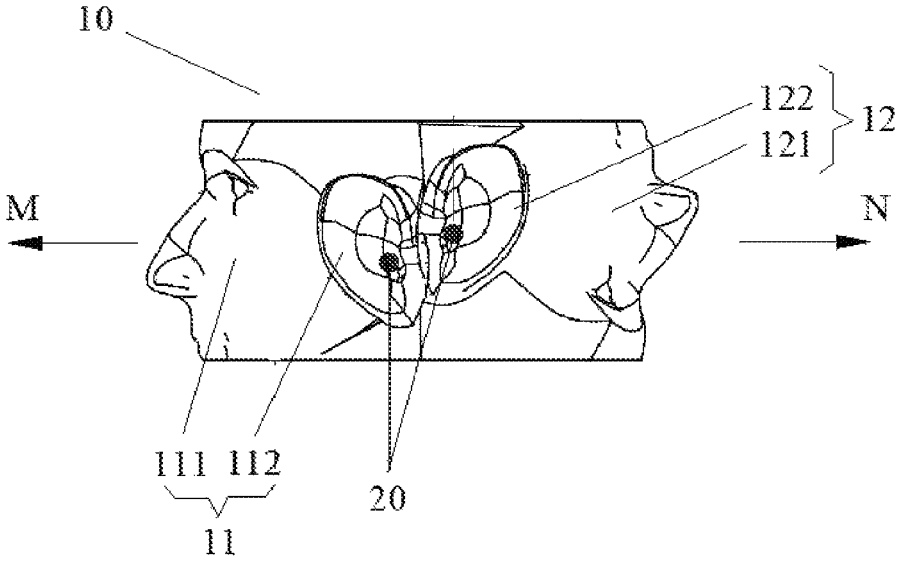
FIG. 2 is a side view of a fixed apparatus according to an embodiment of the present invention.

As shown in FIG. 1 and FIG. 2, in an embodiment of the present invention, the embodiment of the present invention provides a recording device that includes:

several fixed apparatuses 10 that are stacked, where the fixed apparatus 10 has a first fixed structure 11 and a second fixed structure 12 that are used for installing an audio collector 20, and two fixed structures are disposed on the fixed apparatus 10 to reduce the number of required fixed apparatuses 10 in the recording device.

The first fixed structure 11 includes a first simulated face structure 111 and first simulated ear structures 112, and the first simulated ear structures 112 simulate a mutual position relationship between human ears and a human face of a human head and are disposed on two sides of the first simulated face structure 111; that is, a shape and a position arrangement relationship between the first simulated ear structures 112 and the first simulated face structure 111 are created with reference to a shape and a structure of a normal human head. The second fixed structure 12 includes a second simulated face structure 121 and second simulated ear structures 122 disposed on two sides of the second simulated face structure 121. As shown in FIG. 2, the second simulated face structure 121 and the first simulated face structure 111 are inverted to each other, and the second simulated ear structures 122 and the second simulated face structure 121 are inverted to each other. The fixed apparatus 10 has the first fixed structure 11 and the second fixed structure 12, and therefore, mutual interference during audio recording is inevitable. However, a human head structure is oval, a back side of the head is in a top-convex and bottom-concave structure but a front face is in an opposite structure, and sounds transmitted from the back slightly vary with structures of the back side of the head. Therefore, that the second simulated face structure 121 and the first simulated face structure 111 are inverted to each other is a solution designed by conforming to a principle of the structure of the back side of the human head, and a difference is minimized.

It can be understood that the first fixed structure 11 and the second fixed structure 12 herein are artificial human head models with simulated face structures and simulated ear structures. The artificial human head models may be in an artificial human head structure with a complete shape or an incomplete human head structure only reserving fragments in which the first fixed structure 11 and the second fixed structure 12 are located, as shown in FIG. 1 and FIG. 2. In a preferred artificial human head model in this embodiment of the present invention, only a fragment from the mouth to the eyebrows is reserved. In this way, not only the fixed apparatus 10 has a small longitudinal height, but also most of an artificial contour that has main impact on collected sounds is reserved, and integral quality, stereoscopic sensation, and a real restoration degree of collected audio signals are ensured.

The artificial human head model may be a simulated human head model or an artificial human head model that has been dimmed and simplified. The simulated human head model can make a collected audio signal more precise and more targeted, and the artificial human head model that has been dimmed and simplified makes an artificial head contour close to an average level by reducing personal features, so as to improve integral applicability.

The first simulated ear structures 112 and the second simulated ear structures 122 include simulated ear canal openings for placing the audio collectors 20, and the audio collectors 20 are disposed at the simulated ear canal openings of the first simulated ear structures 112 and the second simulated ear structures 122. A process of conducting a sound to an ear drum through an auricle, an external ear, and an ear canal in the first fixed structure 11 and the second fixed structure 12 of the fixed apparatus 10 is similar to a process of transmitting a sound to a human ear; that is, the device can simulate an effect of reflecting and diffracting sound waves by human auricles, ear canals, the human skull, and the like, so that the audio collectors 20 disposed at the ear canal openings can collect verisimilar audio information that is the same as a natural sound heard by the human ear, the sound is rich in quality, and the stereoscopic sensation and authenticity of the sound are ensured.

Two fixed structures are disposed on one fixed apparatus 10, that is, a first fixed apparatus 11 and a second fixed apparatus 12. In this way, when a recording device needs to record multi-channel audio, the number of used fixed apparatuses 10 can be reduced by ½, so that a dimension of a height of the recording device in the present invention is greatly reduced, a distance difference between each fixed apparatus and a sound source emitting point caused by a height problem is optimized, and a time delay difference is generated between the fixed apparatuses. Therefore, an obvious volume difference that is of sounds recorded on two fixed apparatuses far away from each other and that is caused by the height difference between the fixed apparatuses is avoided, so that collected audio signals are as close as possible to an effect of recording on a same horizontal plane.

In an embodiment of the present invention, as shown in FIG. 2, the simulated ear canal openings of the first simulated ear structures 112 and the simulated ear canal openings of the second simulated ear structures 122 are located on different cross sections of the fixed apparatuses 10, so as to ensure that horizontal planes on which the audio collectors 20 placed in the ear canal openings of the first simulated ear structures and the second simulated ear structures are staggered with each other, and impact exerted on an audio collection effect of an audio collector by another simulated ear structure is reduced to the largest extent.

Figure 3:
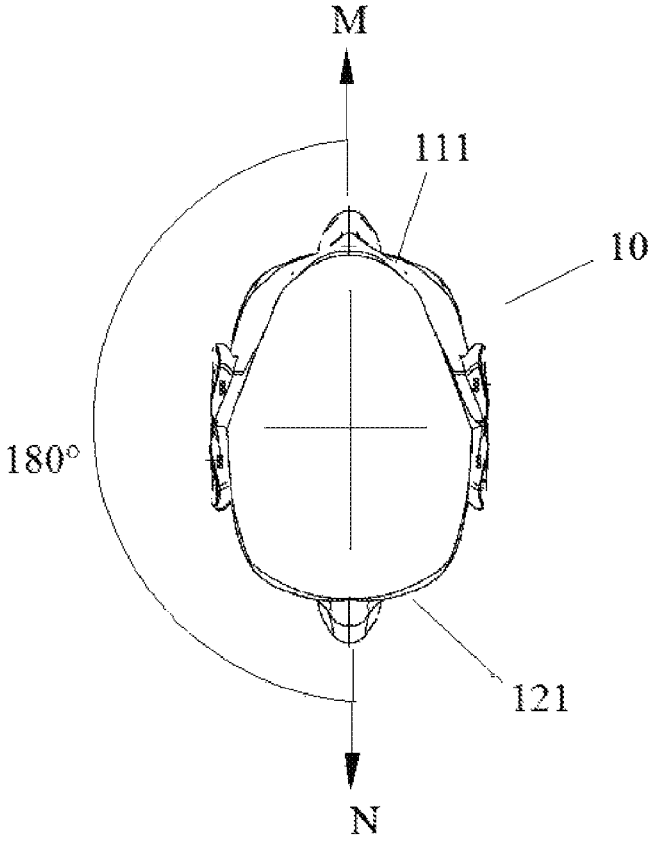
FIG. 3 is a top view of a fixed apparatus according to an embodiment of the present invention.

As shown in FIG. 3, in an embodiment of the present invention, in a same fixed apparatus 10, an included angle between face orientations of a first simulated face structure 111 and the second simulated face structure 121 may be set according to actual application requirements. However, in this embodiment, preferably, an included angle between a face orientation M of the first simulated face structure 111 and a face orientation N of the second simulated face structure 121 is 180 degrees.

In an embodiment of the present invention, face orientations of first simulated face structures of the fixed apparatuses are mutually different, so that the device can collect audio from all angles and sound sources are richer.

In an embodiment of the present invention, with reference to FIG. 1, the fixed apparatuses 10 are arranged in a manner of erecting the first simulated face structures 111 in a vertical direction, so that a head posture when a person is naturally standing or sitting can be simulated, which conforms to sitting postures of most people. In such an arrangement manner, the fixed apparatuses 10 support recording of the audio collectors 20, recorded audio can be better combined with a VR panoramic video technology, and the recorded audio can meet film watching requirements of most people.

In an embodiment of the present invention, the number of fixed apparatuses is K ($2 \leq K \leq 4$); that is, there are at least two fixed apparatuses 10, so that collected audio signals have richer sources.

In an embodiment of the present invention, a straight line on which a central point of a top part and a central point of a bottom part of the fixed apparatus 10 are located is used as a central axis F of the fixed apparatus 10, and the fixed apparatuses are arranged by overlapping central axes F. Therefore, an extremely large interval between the fixed apparatuses 10 in a horizontal direction can be avoided, and collected audio signals are as close as possible to an effect of recording in a same vertical direction or on a same point. When people experience VR film watching, most real human ear simulated sounds at a corresponding angle can be obtained by rotating the head at a same position, VR panoramic sound and image synchronization is ensured, and an optimum panoramic sound effect of being personally on the scene is restored.

Figure 4:
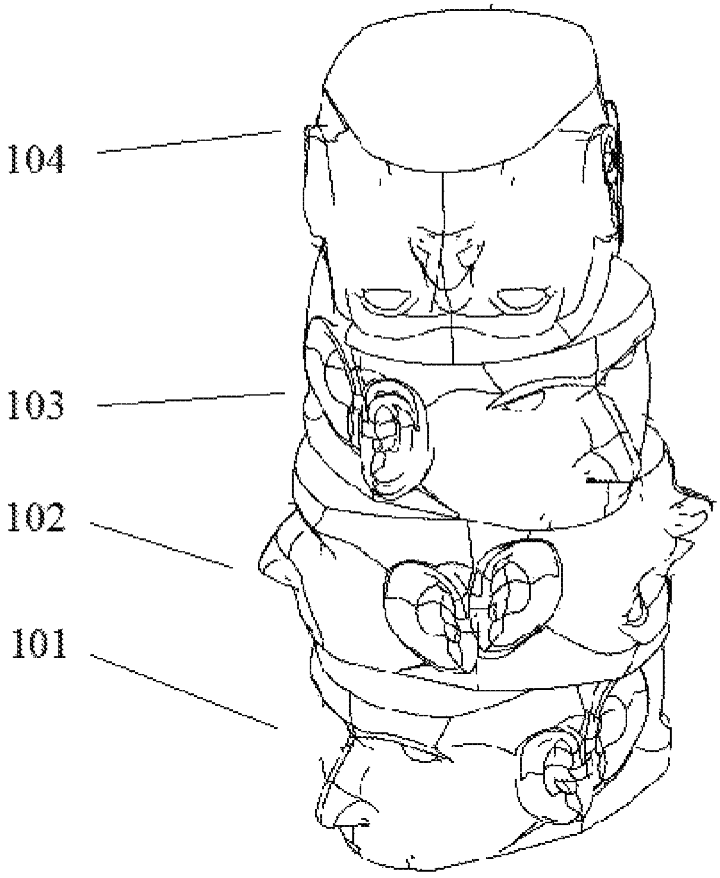
FIG. 4 is a structural diagram of a recording device with four fixed apparatuses according to an embodiment of the present invention.

With reference to FIG. 4, in an embodiment of the present invention, there are four fixed apparatuses 10 that are sequentially a first fixed apparatus 101, a second fixed apparatus 102, a third fixed apparatus 103, and a fourth fixed apparatus 104 from bottom to top.

Figure 5:
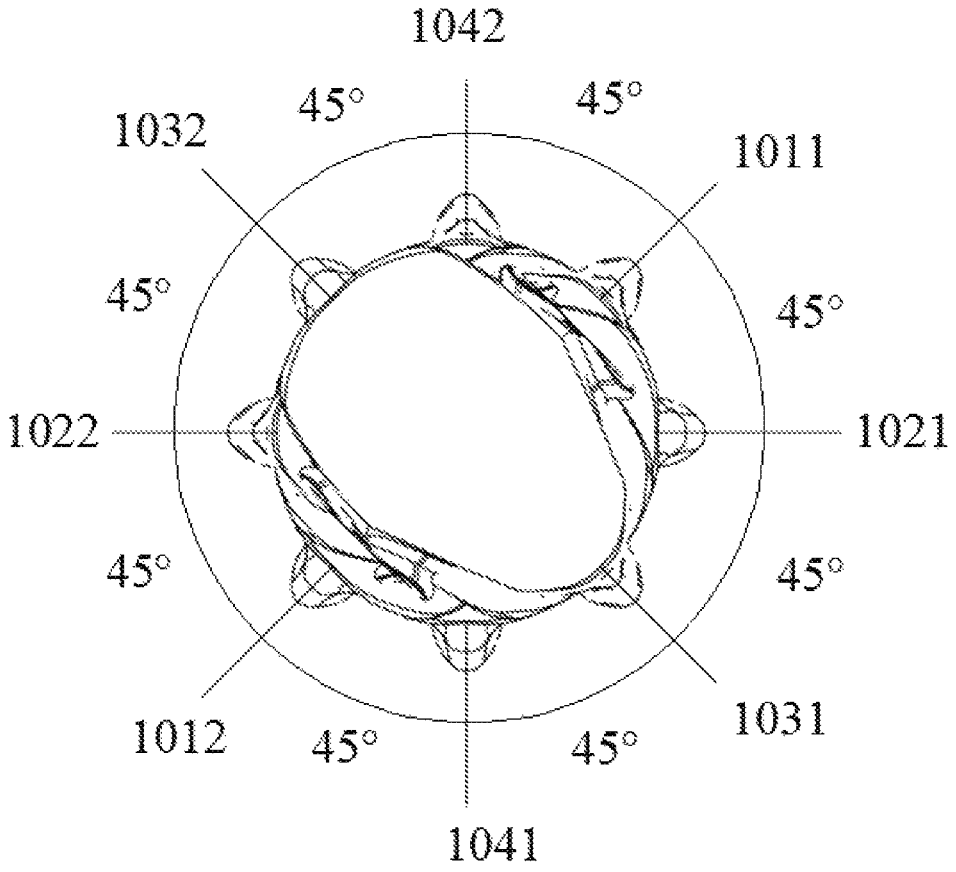
FIG. 5 is a top view of a fixed apparatus according to an embodiment of the present invention.

With reference to FIG. 4 and FIG. 5, in an embodiment of the present invention, an included angle between a face orientation of a first simulated face structure 1021 of the second fixed apparatus and a face orientation of a first simulated face structure 1011 of the first fixed apparatus in a horizontal direction is 45 degrees; an included angle between a face orientation of a first simulated face structure 1031 of the third fixed apparatus and the face orientation of the first simulated face structure 1021 of the second fixed apparatus in the horizontal direction is 45 degrees; an included angle between a face orientation of a first simulated face structure 1041 of the fourth fixed apparatus and the face orientation of the first simulated face structure 1031 of the third fixed apparatus in the horizontal direction is 45 degrees. It may be learned in the foregoing arrangement manner that an included angle between neighboring two of the first simulated face structure 1041 of the fourth fixed apparatus, a second simulated face structure 1012 of the first fixed apparatus, a second simulated face structure 1022 of the second fixed apparatus, a second simulated face structure 1032 of the third fixed apparatus, a second simulated face structure 1042 of the fourth fixed apparatus, and the first simulated face structure 1011 of the first fixed apparatus in sequence is 45 degrees; that is, there is a group of audio collectors 20 every other 45 degrees within 360 degrees, and each group of audio collectors 20 includes a left collector and a right collector. Therefore, the fixed apparatuses of the recording device form an arrangement that uses the central axis F as a central axis, has 8 face orientations, and evenly divides a central angle, so that 8 groups of audio collectors 20 can collect sounds evenly distributed in 16 directions.

In an embodiment of the present invention, during audio collection, and when the number of fixed apparatuses 10 is K ($2 \leq K \leq 4$), face orientations of first simulated face structures and face orientations of second simulated face structures of the fixed apparatuses are staggered around the central axis F in the horizontal direction, and in a projection on a horizontal plane, an included angle between any two neighboring face orientations among the foregoing face orientations is an angle obtained by equally dividing 360 degrees into 2K parts. In this way, first simulated ear structures and second simulated ear structures of the fixed apparatuses are also evenly towards horizontal directions around the central axis F, so that corresponding audio collectors 20 are evenly arranged within a range of 360 degrees in the horizontal direction. In such an arrangement manner, the range of 360 degrees in the horizontal direction can be well and evenly covered. With an increase in the fixed apparatuses 10 and the number of audio collectors 20, the device can evenly capture corresponding audio signals in multiple directions, so as to avoid problems that enough sound sources cannot be obtained and 360-degree complete synchronization with an image of a VR panoramic video cannot be achieved because corresponding audio signals in some directions are not collected due to uneven arrangement.

The present invention provides a recording device. Several fixed apparatuses cooperate with audio collectors disposed on the fixed apparatuses. By using a first fixed structure that has a first simulated face structure and first simulated ear structures and a second fixed structure that has a second simulated face structure and second simulated ear structures, sounds collected by audio collectors disposed in simulated ear canals of the first simulated ear structures and the second simulated ear structures have richer sources, better stereoscopic sensation, and more verisimilar tone quality, and a real sound field can be restored. In addition, two groups of fixed structures are disposed on one fixed apparatus, so that not only the device has a smaller size, but also a recording error is smaller, and requirements of an experience for high-quality audio and experience of being personally on the scene in a VR panoramic video technology are met.

Fixed apparatuses provided in the present invention can be stacked and cooperate with audio collectors disposed on the fixed apparatuses. By using a first fixed structure that has a first simulated face structure and first simulated ear structures and a second fixed structure that has a second simulated face structure and second simulated ear structures, sounds collected by audio collectors disposed in ear canals of the first simulated ear structures and the second simulated ear structures have richer sources, better stereoscopic sensation, and more verisimilar tone quality, and a real sound field can be restored. In addition, two groups of fixed structures are disposed on one fixed apparatus, so that not only the device has a smaller size, but also a recording error is smaller, and requirements of an experience for high-quality audio and experience of being personally on the scene in a VR panoramic video technology are met.

The foregoing descriptions are merely preferred embodiments of the present invention, but are not intended to limit the present invention. Any modification, equivalent replacement, improvement, or the like made within the spirit and principle of the present invention shall fall within the protection scope of the present invention.

The invention claimed is:

1. A recording device, comprising:

multiple fixed apparatuses that are stacked, wherein a fixed apparatus has a first fixed structure and a second fixed structure that are used for installing an audio collector; wherein the first fixed structure comprises a first simulated face structure and first simulated ear structures, and the first simulated ear structures simulate a position relationship between human ears and a human face of a human head and are disposed on two sides of the first simulated face structure;

the second fixed structure comprises a second simulated face structure and second simulated ear structures disposed on two sides of the second simulated face structure, the second simulated face structure and the first simulated face structure are inverted to each other, and the second simulated ear structures and the second simulated face structure are inverted to each other; and the first simulated ear structures and the second simulated ear structures comprise simulated ear canal openings for placing the audio collector.

2. The recording device according to claim 1, wherein the simulated ear canal openings of the first simulated ear structures and the simulated ear canal openings of the second simulated ear structures are located on different cross sections of the fixed apparatus.

3. The recording device according to claim 1, wherein in the same fixed apparatus, face orientations of the first simulated face structure and the second simulated face structure form an angle of 180 degrees.

4. The recording device according to claim 1, wherein first simulated face structures of the fixed apparatuses have different face orientations.

5. The recording device according to claim 1, wherein the fixed apparatuses are arranged in a manner of erecting the first simulated face structures in a vertical direction.

6. The recording device according to claim 1, wherein the number of the fixed apparatuses is K ($2 \leq K \leq 4$).

7. The recording device according to claim 1, wherein a straight line on which a central point of a top part and a central point of a bottom part of the fixed apparatus are located is used as a central axis of the fixed apparatus, and the fixed apparatuses are arranged by mutually overlapping central axes.

8. The recording device according to claim 7, wherein the number of the fixed apparatuses is 4, and the fixed apparatuses are sequentially a first fixed apparatus, a second fixed apparatus, a third fixed apparatus, and a fourth fixed apparatus from bottom to top.

9. The recording device according to claim 8, wherein an included angle between a face orientation of a first simulated face structure of the second fixed apparatus and a face orientation of a first simulated face structure of the first fixed apparatus in a horizontal direction is 45 degrees;

an included angle between a face orientation of a first simulated face structure of the third fixed apparatus and the face orientation of the first simulated face structure of the second fixed apparatus in the horizontal direction is 45 degrees; and an included angle between a face orientation of a first simulated face structure of the fourth fixed apparatus and the face orientation of the first simulated face structure of the third fixed apparatus in the horizontal direction is 45 degrees.

10. The recording, device according to claim 7, wherein the number of the fixed apparatuses is K ($2 \leq K \leq 4$); and during audio collection, face orientations of first simulated face structures and second simulates face structures or the fixed apparatuses are staggered around the central axis in a horizontal direction, and in a projection on a horizontal plane, an included angle between any two neighboring face orientations is an angle obtained by equally dividing 360 degrees into 2K parts.

11. A fixed apparatus, wherein the fixed apparatus has a first fixed structure and a second fixed structure that are used for installing an audio collector;

the first fixed structure comprises a first simulated face structure and first simulated ear structures, and the first simulated ear structures simulate a position relationship between human ears and a human face of a human head and are disposed on two sides of the first simulated face structure;

the second fixed structure comprises a second simulated face structure and second simulated ear structures disposed on two sides of the second simulated face structure, the second simulated face structure and the first simulated face structure are inverted to each other, and the second simulated ear structures and the second simulated face structure are inverted to each other; and the first simulated ear structures and the second simulated ear structures comprise simulated ear canal openings for placing the audio collector.

12. The fixed apparatus according to claim 11, wherein face orientations of the first simulated face structure and the second simulated face structure form an angle of 180 degrees.

* * * * *